United States Patent [19]

Wedeniwski

[11] Patent Number: 4,920,945

[45] Date of Patent: May 1, 1990

[54] METHOD FOR DRESSING GRINDING WHEELS

[76] Inventor: Horst J. Wedeniwski, Beutelsbacher Strasse 8/1, D-7064 Remshalden-Grunbach, Fed. Rep. of Germany

[21] Appl. No.: 288,014

[22] Filed: Dec. 20, 1988

[30] Foreign Application Priority Data

Dec. 23, 1987 [DE] Fed. Rep. of Germany ..... 3743812
Apr. 8, 1988 [DE] Fed. Rep. of Germany ..... 3811782

[51] Int. Cl.[5] ..... B24B 53/00

[52] U.S. Cl. ..... 125/11.03; 125/11.01; 51/325

[58] Field of Search ..... 125/11 CD, 11 NT, 11 R, 125/11 H; 51/5 D, 325

[56] References Cited

U.S. PATENT DOCUMENTS

| | | | |
|---|---|---|---|
| 2,528,621 | 11/1950 | Sweetser | 125/11 CD X |
| 2,664,681 | 1/1954 | Clark et al. | 125/11 CD |
| 3,584,616 | 6/1971 | Flohr | 125/11 |
| 4,073,281 | 2/1978 | Asaeda et al. | 125/11 CD |
| 4,151,684 | 5/1979 | Wada et al. | 125/11 R X |

OTHER PUBLICATIONS

"Handbuch der Fertigungstechnik" from G. Spur and Th. Stöferle, Carl Hanser Verlag, vol. 3/2, 1980, p. 144.

Magazine IDR 1/87 "Abrichten mit Diamant-Abrichtrollen", from Dr.-Ing. F. Klocke and G. Blanke, pp. 14 to 19.

*Primary Examiner*—Robert P. Olszewski

*Attorney, Agent, or Firm*—Walter A. Hackler

[57] ABSTRACT

A method serves for dressing grinding wheels (10) whose surface (16) comprises an embedding compound for CBN crystals. A rotating dressing roll (11) is moved along the surface (16) of the grinding wheel (10). In order to produce sharp-edged points at the CBN grains (20) during the dressing process, and obtain sufficiently large clear chip spaces in the embedding compound, the dressing roll (11) is moved over the said surface (16) at least twice, the first movement being carried out at a first, high rate of feed ($v_3$) so that the dressing crystals of the said dressing roll (11) deflect the said CBN grains (20) elastically while setting back the embedding compound, whereas the second movement is carried out at a second, lower rate of feed ($v_4$) so that the said dressing crystals break up the points of the said CBN grains (20).

11 Claims, 1 Drawing Sheet

METHOD FOR DRESSING GRINDING WHEELS

The present invention relates to a method for dressing grinding wheels whose surface comprises an embedding compound for CBN grains, wherein a rotating dressing roll is moved along the surface of the grinding wheel while the latter rotates in opposite sense.

It has been known before to re-dress worn grinding wheels by moving a dressing roll along their surface. The dressing roll used for this purpose is provided at its circumference with diamonds which attack the worn surface of the grinding wheel so as to restore their sharpness by breaking up the crystals or grains of the material of the grinding wheel. Dressing rolls are usually applied against the grinding surface at a very small clearance angle of, for example, 10° and advanced at a rate of, for example, 0.02 to 0.03 mm per revolution.

Methods of the type described above have been described on page 144 of the textbook "Handbuch der Fertigungstechnik" by G. Spur and Th. Stöerle, published by Carl Hanser Verlag, Munich, Vol. 3/2, 1980.

It has also been known to use CBN grains (CBN=Cubic Bornitride) as material of the grinding wheel. This grinding wheel material has been found to withstand extreme stresses and is, therefore, being currently used in modern grinding machines in order to achieve high chip removal rates. CBN grinding wheels are usually provided on their circumference with an embedding compound with CBN grains embedded therein. The grain-to-compound ratio is usually expressed by so-called concentration factors, a concentration factor of 150 meaning, for example, that the share of embedding compound amounts to 64%, that of the CBN grains to 36%.

However, it has been found in practice that problems may be encountered when dressing CBN grinding wheels if conventional dressing strategies are applied.

Now, it is the object of the present invention to improve a method of the type described at the outset in such a manner that the grinding surface of a CBN grinding wheel can be re-sharpened optimally with a minimum input of time.

This object is achieve according to the invention by a method which is characterized in that the dressing roll is moved over the surface at least twice, the first movement being carried out at a first, high rate of feed so that the dressing crystals of the dressing roll deflect the CBN grains elastically while setting back the embedding compound, whereas the second movement is carried out at a second, lower rate of feed so that the dressing crystals break up the points of the CBN grains.

This solves the object underlying the present invention fully and perfectly.

In the worn condition of the grinding wheel, the CBN grains on the outer circumference of the grinding surface are rounded, and the spaces between the CBN grains are filled either with fouled material from the workpiece or with embedding compound so that altogether a surface with rounded projecting CBN grains and only small recesses between them is obtained.

Now, during the first dressing phase, the CBN grains are deflected elastically by the dressing crystals of the dressing roll because the rate of feed of the dressing roll is set to a relatively high rate. During this operation, the embedding compound between the CBN grains, i.e. the so-called grain bond, is set back by application of a dressing force $F_Q$.

As a result of this operation, relatively big spaces are restored at the surface between the CBN grains. Now, when the points of the CBN grains are broken up during a second dressing phase, during which the dressing roll moves at a slow rate of feed, the points at this surface are restored to their sharp condition and the grinding wheel can work again with full efficiency, the space between the sharpened points of the CBN grains being sufficiently large to accommodate the material removed from the workpiece.

According to a preferred embodiment of the invention, the grinding wheel has a circumferential speed of 25 to 40 m/s, preferably 35 m/s, the circumferential speed of the dressing roll is between −25 and −40 m/s, preferably −32 m/s, the first speed is set to 300 to 900 mm/min., preferably to 400 mm/min., while the second speed is set to 100 to 400 mm/min., preferably to 150 mm/min; in particular, the relative values of the first circumferential speed of the dressing roll and the circumferential speed of the grinding wheel are selected so that their quotient is between 0.75 and 0.95, preferably equal to 0.92.

These process parameters have been found to be particularly advantageous for standard applications where a grinding wheel having a diameter of approx. 600 mm and a thickness of approx. 24 mm is used for cylindrical surface grinding of workpieces.

According to another preferred embodiment of the invention, the dressing roll used exhibits the shape of a double truncated cone and is applied against the surface by the circumferential line at the transition between the conical surfaces.

This feature provides the advantage that the dressing roll itself contacts the surface of the grinding wheel by a pointed edge which facilitates efficiently the removal of material when setting back the embedding compound and breaking up the CBN grains.

According to another preferred embodiment of the invention, the dressing roll is moved along one generating line of the surface, at a first speed in forward direction and at a second speed in reverse direction.

This feature provides the advantage that it permits a simple sequence of movements covering the whole width of the grinding wheel, it being understood that the term "generating line" may mean also a line slightly inclined relative to the axis of the grinding wheel, as described at the outset.

Finally, a particular good effect is achieved when a ceramic material, or a metallic bonding agent, in particular a galvanically applied bonding agent, is used as an embedding compound.

This provides the advantage that the CBN grains are retained in the embedding compound with sufficient strength so that there is no risk that the grains may break off.

Other advantages of the invention will appear from the specification and the attached drawing.

It is understood that the features that have been described before and will be explained hereafter may be used not only in the described combinations, but also in any other combination, or individually, without leaving the scope and intent of the present invention.

One embodiment of the invention will now be described in more detail with reference to the drawing in which.

Figure 1:
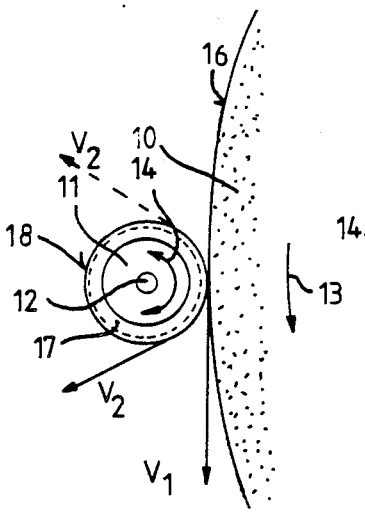
FIG. 1 shows a side view, partly broken away, of an arrangement comprising a grinding wheel and a dressing roll, illustrating the method according to the invention.
Figure 2:
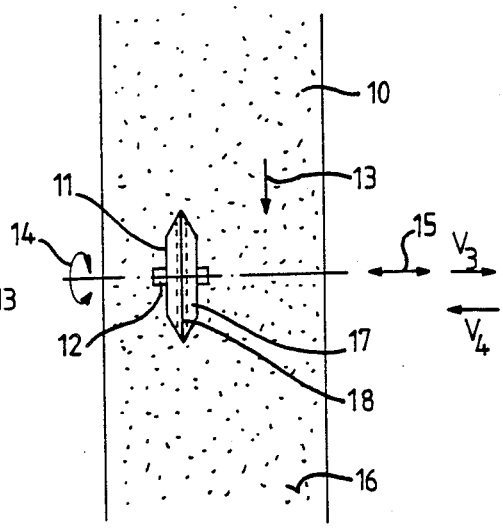
FIG. 2 shows a front view of the arrangement illustrated in FIG. 1.

In FIGS. 1 and 2, a grinding wheel of the type used, for example, for circular surface grinding or profile grinding, is indicated generally by reference numeral 10. A grinding wheel used for typical application has, for example, a diameter of approx. 600 mm and a width of approx. 24 mm.

The grinding wheel 10, whose surface has been worn by extended use, is dressed by means of a dressing roll 11 rotating about an axis 12. The axis 12 extends in parallel, or at a slight angle to, the axis of the grinding wheel 10.

An arrow 13 indicates, by way of example, the sense of rotation of the grinding wheel 10, while an arrow 14 indicates that the dressing roll 11 may rotate either in the same or in opposite direction relative to the grinding wheel 10. An arrow 15 finally indicates that the dressing roll 11 can be moved in two directions across the surface 16 of the grinding wheel 10, in the sense of its axis 12.

The dressing roll 11 has, preferably, the shape of a double cone with the two conical surfaces 17 meeting approximately at a central plane of the dressing roll 11, forming between them a sharp circumferential line 18 by which the dressing roll 11 is applied against the surface 16 of the grinding wheel 10. In the area of this circumferential line 18, the dressing roll 11 is garnished with diamonds in the conventional manner.

In FIG. 1, $v_1$ marks the circumferential speed encountered at the circumference of the grinding wheel 10. This circumferential speed $v_1$ is preferably equal to 35 m/s, but may also vary within a range of approx. 25 to 40 m/s.

correspondingly, $v_2$ indicates the circumferential speed of the dressing roll 11. While the circumferential speed $v_2$ of the dressing roll 11 is preferably equal to $-32$ m/s, it may also vary within a range of from $-10$ to $-40$ m/s. The minus sign used is meant to indicate that the circumferential speed vectors $v_1$ and $v_2$ are oppositely directed at the point of contact between the dressing roll 11 and the grinding wheel 10.

For dressing the grinding wheel 10, the dressing roll 11 may, for example, be applied at the left edge—as viewed in FIG. 2—of the width of the surface 16 of the grinding wheel 10 and then be moved to the right at a first, high rate of feed $v_3$. This first rate of feed is preferably equal to 400 mm/min., but may also vary within a range of between 300 to 900 mm/min.

Once the dressing roll 11 has reached the right edge—in FIG. 2—its direction of feed is reversed and the roll is moved back at a second, lower rate of feed $v_4$. During this motion, the dressing roll 11 runs along the same generating line of the surface 16 along which it had moved during its advance motion at the rate of feed $v_3$. The second, lower rate of feed $v_4$ is preferably equal to 150 mm/min., but may also vary within a range of between 100 and 400 mm/min.

Figure 3:
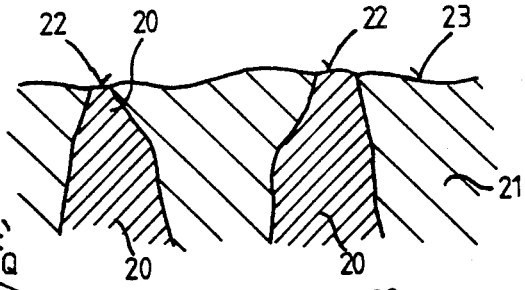
FIG. 3 shows a diagrammatic view, in greatly enlarged scale, of a surface structure of a grinding wheel in the undressed condition.

This procedure results in the following mechanism:

FIG. 3 shows the surface of the grinding wheel 10 in greatly enlarged scale. CBN grains 20 are embedded in a ceramic bonding agent 21 serving as bonding compound. FIG. 3 shows the grinding wheel 10 in the worn condition where the points 22 of the CBN grains 20 are already largely rounded. Moreover, there do not exist in this condition any clear spaces between the points 22 of neighboring CBN grains 20. This condition is due either to the fact that the CBN grains 20 have been worn down to a first surface 23 of the embedding compound 21, or to the fact that these spaces have been filled up with material removed from the workpiece being processed.

In the worn condition of the grinding wheel 10 illustrated in FIG. 3, the grinding wheel is no longer capable of working a workpiece efficiently.

The procedure described before with reference to FIGS. 1 and 2, using a relatively high rate of feed $v_3$, now permits the diamonds provided along the circumferential line 18 of the dressing roll 11 to pass the surface of the grinding wheel 10 at relatively high speed. The rate of feed $v_3$ is adjusted in response to the modulus of elasticity of the CBN grinding wheel 10 in such a manner that, as the dressing roll 11 moves forward at its high rate of feed $v_3$, the diamonds arranged along the circumferential line 18 attack the CBN grains 20 in their elastic range.

Figure 4:
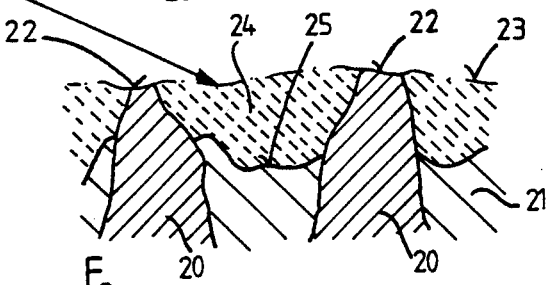
FIG. 4 shows the arrangement of FIG. 3, by in an advanced phase of the method according to the invention.

FIG. 4 shows that a dressing force $F_Q'$ can be preset, by value and direction, by adjusting the circumferential speeds $v_2$ and $v_3$ appropriately. During the first phase, using the high rate of feed $v_3$, the CBN grains 20 are deflected by the dressing force $V_Q'$ indicated in FIG. 4. Consequently, the embedding compound is "set back", i.e. reduced, by a first area 24 indicated by broken lines in FIG. 4. One obtains in this manner, between the intact CBN grains 20, chip spaces, i.e. clear spaces, whose second surface 25 occupies a position notably lower than their first surface 23 in the initial condition illustrated in FIG. 3.

Consequently, the CBN grains 20 now project far beyond the second surface 25, and the clear space existing between the CBN grains 20 is now sufficient to receive the chips removed from a workpiece being processed. In addition, the shape of the chip spaces ensures that the chips cannot penetrate into the embedding compound 21.

Figure 5:
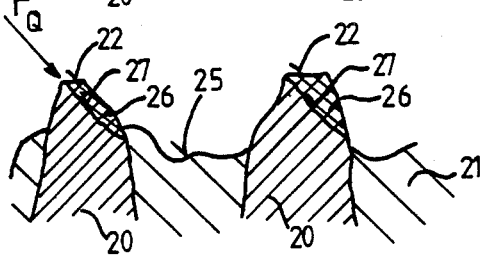
FIG. 5 shows a representation similar to that of FIG. 4, but in a still further advanced phase of the method according to the invention.

During the second movement of the dressing roll 11 at the reduced rate of feed $v_4$, the CBN grains 20 are now subjected to the action of another dressing force $F_Q$ whereby they are broken up in the area 26 of their points 22, as indicated by broken lines in FIG. 5. One obtains in this manner new points 27 with sharp edges, as is indicated very diagrammatically in FIG. 5.

The grinding wheel 10 obtained after execution of the above procedure exhibits a surface with sharp-edged CBN grains 20 projecting far beyond a surface 25 of the embedding ceramic compound 21, so that the grinding wheel 10 is again capable of machining a workpiece efficiently and of achieving high rates of metal removal.

It is understood that the method described before by way of example constitutes only one of numerous imaginably variants covered by the present invention.

For example, it has been mentioned before that the dressing roll 11 may be guided not only along a generating line of the grinding wheel 10, but also along a straight line slightly inclined relative to the said generating line, or even along other lines.

It goes without saying that the method according to the invention is equally well suited for cylindrical and conical grinding wheels, and also for all known grinding techniques.

Finally, it is also possible to use a synthetic resin or a metal, for example a sintered or galvanized metal as an embedding compound, instead of the ceramic material.

I claim:

1. A method for dressing grinding wheels, said grinding wheels having a peripheral layer consisting of an embedding compound with cubic boron nitride (CBN) grains embedded therein and portions of said grains protruding therefrom, said peripheral layer having a cylindrical or conical surface with a straight generatrix line, said method utilizing a dressing roll with dressing crystals protruding therefrom with portions of said crystals, said method comprising the steps of:

rotating said grinding wheel at a first circumferential speed about a first axis in a first rotational direction;

rotating said dressing roll at a second circumferential speed about a second axis being essentially parallel to said generatrix line, in a second rotational direction being opposite to said first rotational direction;

approaching said dressing roll and said grinding wheel relative to each other such that said dressing roll and said grinding wheel contact each other at said generatrix line with said protruding grain portions engaging said protruding crystal portions;

displacing said dressing roll in a first feed direction along said generatrix line with a first, higher feed speed being set such that said grain portions are elastically deflected by said crystal portions while said embedding compound is set back between said grains;

displacing said dressing roll in a second direction along said generatrix line with a second feed, lower feed speed being set such that tips of said grain portions are broken by said crystal portions.

2. The method of claim 1 wherein said first direction and said second direction are opposite to each other.

3. The method of claim 1 wherein said first circumferential speed is between 25 and 40 m/s, preferably at 35 m/s.

4. The method of claim 1 wherein said second circumferential speed is between 10 and 40 m/s, preferably at 32 m/s.

5. The method of claim 1 wherein said first feed speed is between 300 and 900 mm/min., preferably at 400 mm/min.

6. The method of claim 1 wherein said second feed speed is between 100 and 400 mm/min. and preferably at 150 mm/min.

7. The method of claim 1 wherein said first and second circumferential speeds are set such that a quotient of said second circumferential speed and said first circumferential speed is between 0.75 and 0.95, preferably at 0.92.

8. The method of claim 1 wherein said dressing roll is desined in the shape of a double truncated cone with a first and a second conical surface, said dressing roll being applied against said peripheral layer by a circumferential line defining a transition between said conical surfaces.

9. The method of claim 1 wherein a ceramic material is used as said embedding compound.

10. The method of claim 1 wherein a metallic bonding agent is used as said embedding compound.

11. The method of claim 10 wherein said metallic bonding agent is applied by a galvanic method.

* * * * *